US010245738B2

(12) United States Patent
Zhang

(10) Patent No.: US 10,245,738 B2
(45) Date of Patent: Apr. 2, 2019

(54) SAMPLING SCISSORS AND METHOD FOR USING THE SAME

(71) Applicants: BOE TECHNOLOGY GROUP CO., LTD., Beijing (CN); BEIJING BOE OPTOELECTRONICS TECHNOLGY CO., LTD., Beijing (CN)

(72) Inventor: Jie Zhang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 140 days.

(21) Appl. No.: 14/800,587

(22) Filed: Jul. 15, 2015

(65) Prior Publication Data

US 2016/0271811 A1 Sep. 22, 2016

(30) Foreign Application Priority Data

Mar. 19, 2015 (CN) ..... 2015 1 0122356

(51) Int. Cl.
*B26B 13/22* (2006.01)

(52) U.S. Cl.
CPC ..... *B26B 13/22* (2013.01)

(58) Field of Classification Search
CPC .... B25B 7/22; B25B 7/02; B25B 7/04; B25B 5/06; B25B 5/163; B25B 1/20;
(Continued)

(56) References Cited

U.S. PATENT DOCUMENTS 1,508,687 A * 9/1924 Gilley ..... B25B 7/02 30/349
1,892,082 A * 12/1932 Shekerjian ..... B25B 7/02 254/21

(Continued)

FOREIGN PATENT DOCUMENTS

CN 1342061 A 3/2002
CN 2668349 Y 1/2005

(Continued)

OTHER PUBLICATIONS

First Chinese Office Action, for Chinese Patent Application No. 2015101223567, dated Oct. 8, 2016, 6 pages.

(Continued)

*Primary Examiner* — Stephen Choi
*Assistant Examiner* — Liang Dong
(74) *Attorney, Agent, or Firm* — Kinney & Lange, P.A.

(57) ABSTRACT

Embodiments of the present invention provide a pair of sampling scissors and a method for using the sampling scissors. With the sampling scissors and the method, a sample of a rubbing cloth for testing may be obtained in a single operation, and damage to the rubbing cloth during the sampling process is thus decreased, so that the rubbing cloth will meet the requirement of uniformity of rubbing alignment. The sampling scissors comprise a tray, a blade, a first hand grip and a second hand grip; wherein the tray is connected with the first hand grip and the blade is connected with the second hand grip, and the first hand grip is pivotably connected with the second hand grip through a central shaft; and wherein the blade comprises a first cutting edge disposed at edges of the blade, and a projection of the first cutting edge onto a bottom surface of the tray is a hollow and closed pattern and the first cutting edge is perpendicular to the bottom surface of the tray for shearing off a sample which is to be received in the tray. The sampling scissors (Continued)

according to embodiments of the present invention are used to sample the rubbing cloth.

15 Claims, 6 Drawing Sheets

(58) Field of Classification Search
CPC ..... B25B 7/123; B25B 5/12; B26B 13/00; B26B 13/02; B26B 13/28; B26B 13/285; A24F 13/24; A61C 3/14; B26F 1/36
USPC ..... 7/129–135; 269/261
See application file for complete search history.

(56) References Cited

U.S. PATENT DOCUMENTS

| | | | | |
|---|---|---|---|---|
| 4,817,287 | A | 4/1989 | Arnold et al. | |
| 5,052,258 | A * | 10/1991 | Hunter | B26F 1/36 30/229 |
| 5,884,540 | A * | 3/1999 | Mo | B25B 7/04 81/423 |
| 6,581,293 | B1 * | 6/2003 | Andersen | A61F 5/445 30/177 |
| 7,415,912 | B2 * | 8/2008 | Tyler | B25B 5/163 81/367 |
| 7,905,162 | B2 * | 3/2011 | Nguyen | B25B 13/481 81/57.3 |
| 8,230,715 | B2 * | 7/2012 | Battenfeld | B25B 7/04 72/409.11 |
| 2006/0162170 | A1 * | 7/2006 | Yu | B26F 1/36 30/340 |
| 2007/0157473 | A1 | 7/2007 | Varnell | |
| 2008/0072727 | A1 * | 3/2008 | Geyfen | B23D 29/023 83/522.19 |
| 2015/0114188 | A1 * | 4/2015 | Bullard | B21D 28/34 83/13 |

FOREIGN PATENT DOCUMENTS

| | | | |
|---|---|---|---|
| CN | 201405362 | Y | 2/2010 |
| CN | 201425554 | Y | 3/2010 |
| CN | 101726428 | A | 6/2010 |
| CN | 201659573 | U | 12/2010 |
| CN | 202016073 | U | 10/2011 |
| CN | 202330054 | U | 7/2012 |
| CN | 203683542 | U | 7/2014 |
| CN | 203869890 | U | 10/2014 |
| KR | 200401071 | Y1 | 11/2005 |
| KR | 20060011613 | A | 2/2006 |
| KR | 20130067548 | A | 6/2013 |

OTHER PUBLICATIONS

Third Chinese Office Action, for Chinese Patent Application No. 201510122356.7, dated Aug. 1, 2017.
Second Chinese Office Action, for Chinese Patent Application No. 201510122356.7, dated Apr. 19, 2017, 10 pages.
Fourth Chinese Office Action, for Chinese Patent Application No. 201510122356.7, dated Oct. 25, 2017, 15 pages.

* cited by examiner

SAMPLING SCISSORS AND METHOD FOR USING THE SAME

BACKGROUND OF THE INVENTION

Field of the Invention

Embodiments of the present invention relate to the field of manufacturing technologies of display devices, in particular, to a pair of sampling scissors.

Description of the Related Art

In a manufacturing technology of a liquid crystal display (LCD), a rubbing process is typically used to pre-process an aligned film. The rubbing process mainly comprises steps of: placing a substrate coated with a polyimide (PI) film on a bearing platform; rolling, on the bearing platform, a rubbing roller pre-wrapped with rubbing cloth on its surface at a predefined rotation speed so as to drive the rubbing cloth to roll over the PI film of the substrate at a certain pressure; forming an aligned film having slots therein through an interaction between piles on the surface of the friction cloth and the surface of the PI film during the rolling of the rubbing cloth. Once the rubbing process is completed, the substrate is assembled with another substrate, and liquid crystals are poured into a space between the two substrates. An anchoring energy is generated between liquid crystal molecules and the aligned film, thus the liquid crystal molecules are arranged in sequence along the slots, so that an arrangement of the liquid crystal molecules in the aligned film meets the requirement of a pretilt angle.

During the rubbing process, uniformity of the directional arrangement of the liquid crystal molecules and thus a display quality of the LCD display directly depend on the rubbing effect, which is in turn determined by a quality of the rubbing cloth. During manufacture, test and transportation, the rubbing cloth may be damaged such that some impurities in a weaving and dyeing process may present in the rubbing cloth, or the rubbing cloth may have a non-uniform thickness or some other objects may present in the surface of the rubbing cloth, for example. These defects may affect a quality of the piles of the rubbing cloth for forming the slots, which leads to an insufficient resilience of the piles. If the piles are unable to recover during a continuous rubbing, the aligned film at a corresponding rubbing position has a poor uniformity, and an aligned performance is thereby affected.

An existing method for testing the quality of the rubbing cloth comprises steps of: shearing off a sample from the rubbing cloth; placing the sample in a cyclic compressing and recovering device; testing the resilience of the piles of the sample after being compressed repeatedly to determine whether a predefined threshold is met. It is determined that the rubbing cloth corresponding to the sample is able to meet the requirement of the uniformity when performing the rubbing process with the rubbing cloth, if the predefined threshold is met. In prior arts, the sampling is performed through a commonly used scissor. During the shearing process, a pair of scissors are needed to continuously shear the rubbing cloth, so that the piles of the rubbing cloth around the sample will be pressed and thus deformed. And in the same time, during the shearing process, the rubbing cloth needs to be pulled, which further affects the positions and the sequence of the piles, so that the rubbing cloth will not meet the requirement of the uniformity of rubbing alignment.

SUMMARY OF THE INVENTION

Embodiments of the present invention provide a pair of sampling scissors and a method for using the pair of sampling scissors. In the embodiments of the present invention, a sample of a rubbing cloth for test may be obtained in a single operation, a damage of the rubbing cloth during the sampling process is thus decreased, so that the rubbing cloth will meet the requirement of the uniformity of rubbing alignment.

In order to achieve the above objectives, the embodiments of the present invention provide the following solutions.

According to an aspect, the embodiments of the present invention provide a pair of sampling scissors comprising a tray, a blade, a first hand grip and a second hand grip;

wherein the tray is connected with the first hand grip and the blade is connected with the second hand grip, and the first hand grip is pivotably connected with the second hand grip through a central shaft; and wherein the blade comprises a first cutting edge disposed at edges of the blade, a projection of the first cutting edge onto a bottom surface of the tray is a hollow and closed pattern, the first cutting edge is perpendicular to the bottom surface of the tray for shearing off a sample, and the tray is configured to receive the sample.

Optionally, the tray comprises a second cutting edge which is perpendicular to the bottom surface of the tray and is able to cooperate with the first cutting edge to shear off the sample.

Optionally, the sampling scissors further comprise a first guide rail which is fixed to the second hand grip, wherein a first slider is disposed on the first guide rail and is fixed to the blade, thereby the blade is slidable along the first guide rail through the first slider.

Optionally, the sampling scissors further comprise a first position fixing device for fixing a position of the first slider on the first guide rail.

Optionally, the first position fixing device is a clip which is movable along the first guide rail.

Optionally, a first groove is disposed in the first guide rail, the first groove comprises a first opening close to the first slider, a width of the first opening is smaller than a width of the first groove, the first slider comprises a travelling element, and a width of the travelling element is smaller than or equal to that of the first groove but larger than that of the first opening.

Optionally, the sampling scissors further a second guide rail which is fixed to the first hand grip, wherein a second slider is disposed on the second guide rail and is fixed to the tray, thereby the tray is slidable along the second guide rail through the second slider.

Optionally, a second groove is disposed in the second guide rail. And the second groove comprises a second opening close to the second slider, a width of the second opening is smaller than a width of the second groove, and the second slider comprises a travelling element, and a width of the travelling element is smaller than or equal to that of the second groove but larger than that of the second opening.

Optionally, scales for indicating positions of the blade and/or the tray are disposed on the first guide rail and/or the second guide rail respectively.

Optionally, the sampling scissors further comprise a second position fixing device for fixing a position of the second slider on the second guide rail.

Optionally, the projection of the first cutting edge onto the bottom surface of the tray is a hollow quadrilateral.

Optionally, the quadrilateral is a square with a side length of 7 cm.

Optionally, the projection of the first cutting edge onto the bottom surface of the tray is a hollow circle.

According to another aspect, an embodiment of the present invention further provides a method for shearing a sample using the above sampling scissors comprising steps of:

placing an object to be sampled between the tray and the blade;

gripping the first hand grip and the second hand grip to decrease a distance therebetween;

decreasing a distance between the tray and the blade as the distance between the first hand grip and the second hand grip decreases, the blade piercing through the object to be sampled and contacting the tray when a distance between the bottom surface of the tray and the first cutting edge is small enough;

obtaining the sample through a single shearing by the sampling scissors and receiving it in the tray.

According to another aspect, an embodiment of the present invention further provides a method for shearing a sample using the above sampling scissors comprising steps of:

placing an object to be sampled between the tray and the blade;

sliding the first slider on the first guide rail to position the blade in a position for shearing off the sample;

gripping the first hand grip and the second hand grip to decrease a distance therebetween;

decreasing a distance between the tray and the blade as the distance between the first hand grip and the second hand grip decreases, the blade piercing through the object to be sampled and contacting the tray when a distance between the bottom surface of the tray and the first cutting edge is small enough;

obtaining the sample through a single shearing by the sampling scissors and receiving it in the tray.

Optionally, the object to be sampled is a rubbing cloth for a rubbing process, a fabric, a plastic plate, a rubber or metal plate.

Embodiments of the present invention provide a pair of sampling scissors and a method for using the sampling scissors, wherein the sampling scissors comprise a tray, a blade, a first hand grip and a second hand grip. Wherein the tray is connected with the first hand grip and the blade is connected with the second hand grip, and the first hand grip is pivotably connected with the second hand grip through a central shaft. And the blade comprises a first cutting edge disposed at edges of the blade, and a projection of the first cutting edge onto a bottom surface of the tray is a hollow closed pattern and the first cutting edge is perpendicular to the bottom surface of the tray for shearing a sample which is received in the tray. Compared with the prior art, because the first cutting edge is disposed at edges of the blade and the projection of the first cutting edge onto a bottom surface of the tray is a closed pattern, when the rubbing cloth is placed between the blade and the tray, the sample of the rubbing cloth may be sheared off by the first cutting edge of the blade by decreasing the distance between the first hand grip and the second hand grip. And the sample has the same shape as the hollow portion of the projection of the first cutting edge, then the sheared sample is received in the tray. The sample of the rubbing cloth may be obtained through a single shearing operation, the damage to the piles of the rubbing cloth around the sheared portion during the continuous shearing process is thus avoided. And it is not necessary to pull the rubbing cloth during the shearing process, the deformation of the rubbing cloth is thus avoided, thereby the change of the positions and the sequence of the piles is also avoided. Therefore, the rubbing cloth will meet the requirement of the uniformity of rubbing alignment.

BRIEF DESCRIPTION OF THE DRAWINGS

In order to illustrate the technical solution of the prior art or embodiments of the present invention more clearly, a simply introduction about the drawings of the prior art or the embodiments will be made in the following, and obviously, the drawings described later relate to only some embodiments of the present invention. Other drawings will also be obtained by those skilled in the art without any creative effort according to these drawings.

DETAILED DESCRIPTION OF PREFERRED EMBODIMENTS OF THE INVENTION

The embodiments of the present invention will be described clearly and completely hereinafter in conjunction with the drawings. Obviously, the followings are merely a part of, rather all of, the embodiments of the present invention. All other embodiments obtained by those skilled in the art without paying a creative effort based on the embodiments should also fall in the scope of the present invention.

Figure 1:
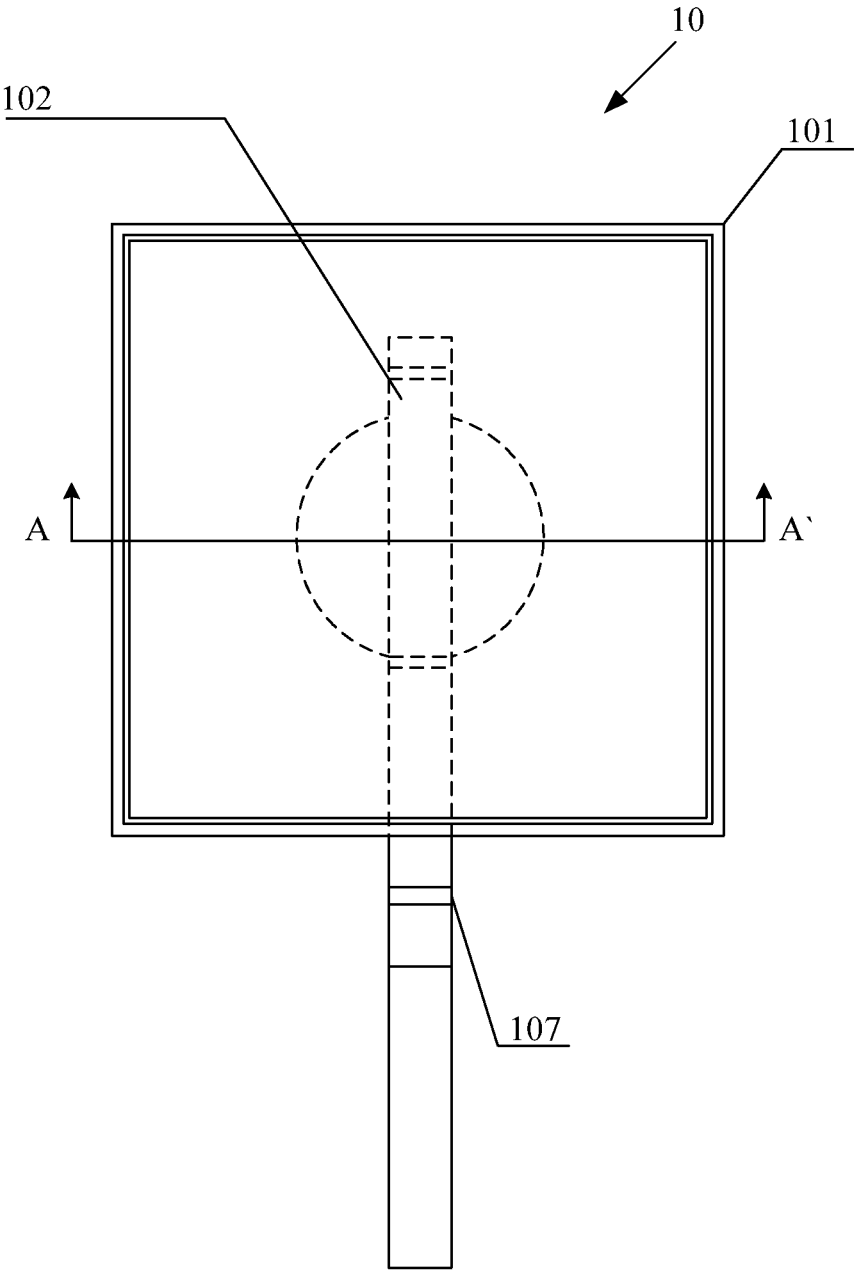
FIG. 1 is a front view of a pair of sampling scissors according to an embodiment of the present invention.
Figure 2:
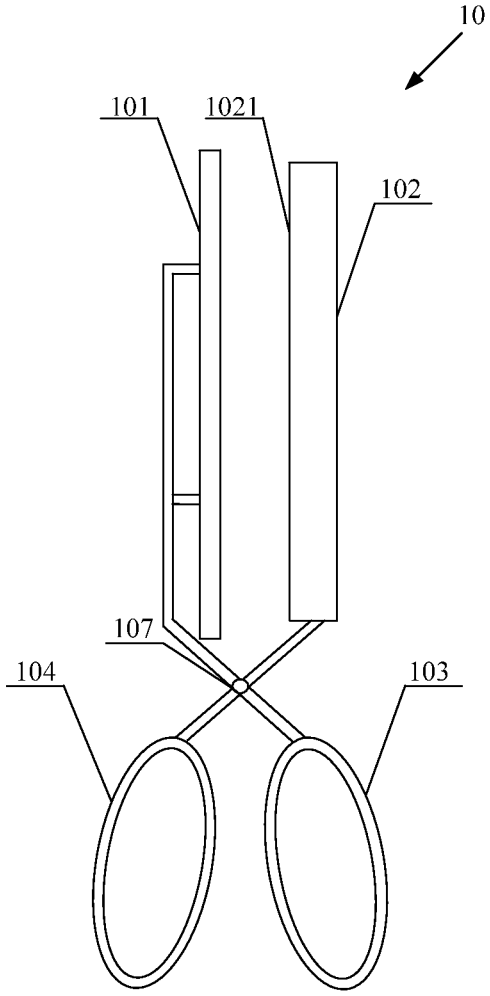
FIG. 2 is a side view of the pair of sampling scissors according to the embodiment of the present invention.

An embodiment of the present invention provides a pair of sampling scissors 10. As shown in FIGS. 1 and 2, wherein FIG. 2 is a side view of FIG. 1, the pair of sampling scissors 10 comprise a tray 101, a blade 102, a first hand grip 103 and a second hand grip 104.

Wherein, the tray 101 is connected with the first hand grip 103 and the blade 102 is connected with the second hand grip 104, and the first hand grip 103 is pivotably connected with the second hand grip 104 through a central shaft 107.

Figure 3:
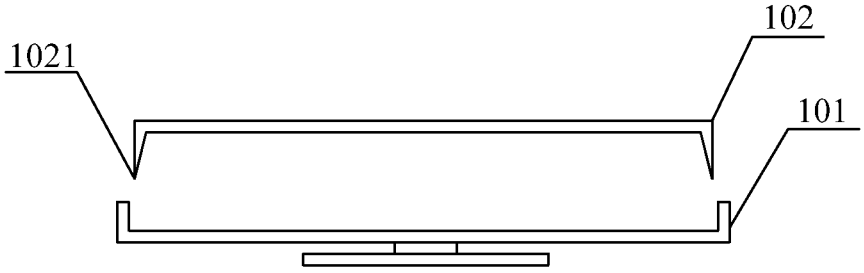
FIG. 3 is a section view of the pair of sampling scissors according to the embodiment of the present invention.

As shown in FIG. 3, which is a section view along a line A-A' of FIG. 1, the blade 102 comprises a first cutting edge 1021 disposed at edges of the blade 102, and a projection of the first cutting edge 1021 on a bottom surface of the tray 101 is a hollow and closed pattern and the first cutting edge is perpendicular to the bottom surface of the tray 101 for shearing off a sample. The tray 101 is used to receive the sample sheared off.

Since the first cutting edge is disposed at edges of the blade and the projection of the blade onto the bottom surface of the tray is a closed pattern, when the rubbing cloth is placed between the blade and the tray, the blade may shear off a sample from the rubbing cloth with the first cutting edge as a distance between the first hand grip and the second hand grip is decreased, and the sample has the same shape as the hollow portion of the projection of the first cutting edge, then the sample sheared off is received in the tray. Since the sample of the rubbing cloth may be obtained through one single shearing operation, damage to the piles of the rubbing cloth around the portion being sheared during the continuous shearing process is thus avoided. And it is not necessary to pull the rubbing cloth during the shearing process, a deformation of the rubbing cloth is thereby avoided, and in turn a change in the positions and sequences of the piles is also avoided, such that the rubbing cloth will meet the requirement of the uniformity of rubbing alignment.

Figure 4:
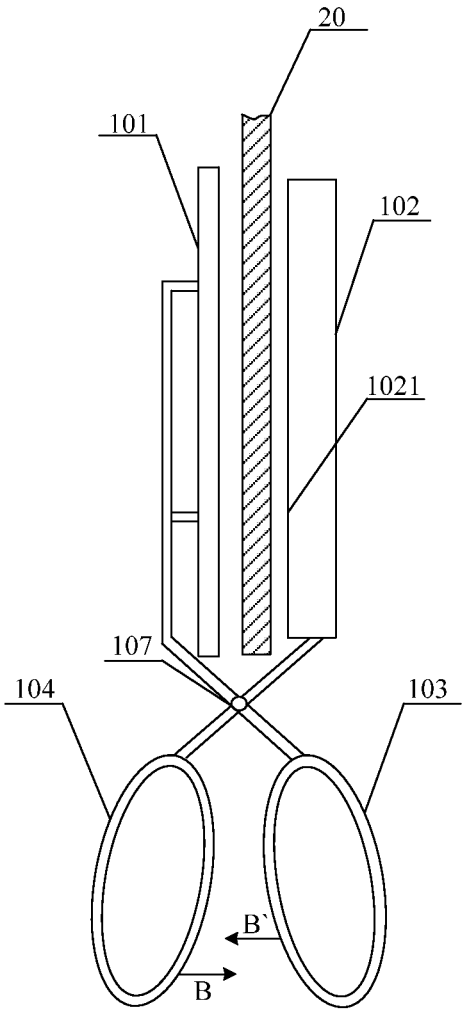
FIG. 4 is a schematic view showing an operation of the pair of sampling scissors according to the embodiment of the present invention.

It will be explained that, firstly, during shearing off the sample from the rubbing cloth, as shown in FIG. 4, the rubbing cloth 20 is placed between the tray 101 and the blade 102. Then, the first hand grip 103 and the second hand grip 104 may be gripped by two hands respectively to decrease a distance therebetween, that is, the first hand grip 103 moves in a direction indicated by an arrow B' in FIG. 4 while the second hand grip 104 moves in a direction indicated by an arrow B in FIG. 4. Since the first hand grip 103 is connected with the second hand grip 104 through the central shaft 107, the distance between the tray 101 and the blade 102 is decreased as the distance between the first hand grip 103 and the second hand grip 104 is decreased. The blade pierces through the rubbing cloth 20 and contacts the tray 101 when the distance between the bottom surface of the tray 101 and the first cutting edge 1021 is small enough. Thereby, a sample of the rubbing cloth 20 is received in the tray.

Secondly, in practical applications, the sampling scissors 10 may be used for sampling a variety of samples, for example, fabric, plastic plate, rubber or metal plate. Embodiments of the present invention are explained in connection with the rubbing cloth 20. However, it is not intended to limit the application of the sampling scissors 10.

Another embodiment of the present invention provides a pair of sampling scissors 10. The pair of sampling scissors 10 comprise a tray 101, a blade 102, a first hand grip 103 and a second hand grip 104.

Wherein, the tray 101 is connected with the first hand grip 103 and the blade 102 is connected with the second hand grip 104, and the first hand grip 103 is pivotably connected with the second hand grip 104 through a central shaft 107.

The blade 102 comprises a first cutting edge 1021 disposed at edges of the blade 102, and a projection of the first cutting edge 1021 onto a bottom surface of the tray 101 is a hollow and closed pattern and the first cutting edge is perpendicular to the bottom surface of the tray 101 for shearing off a sample. The tray 101 is used to receive the sample sheared off.

Figure 5:
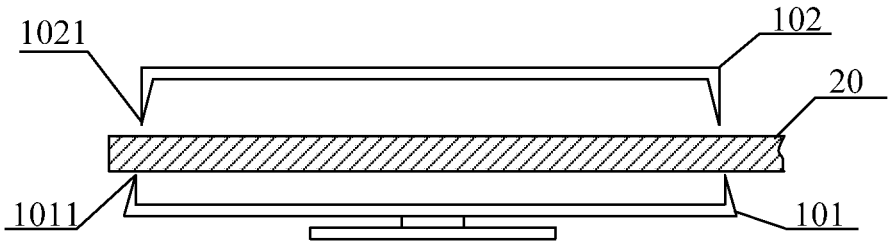
FIG. 5 is a schematic view of a pair of sampling scissors according to another embodiment of the present invention.

Optionally, as shown in FIG. 5, the tray 101 comprises a second cutting edge 1011 which is perpendicular to the bottom surface of the tray 101. The second cutting edge 1011 has the same shape as the first cutting edge 1021 and is used to cooperate with the first cutting edge 1021 to shear off the sample.

As an example, the cooperation between the first cutting edge 1021 and the second cutting edge 1011 is similar to the cooperation between two cutting edges of a pair of common scissors. When sampling the rubbing cloth 20, the rubbing cloth 20 is placed between the tray 101 and the blade 102. Then, the first hand grip 103 and the second hand grip 104 are gripped by two hands respectively to decrease a distance therebetween, thereby the distance between the tray 101 and the blade 102 is also decreased. The rubbing cloth 20 is being sheared when a distance between the first cutting edge 1021 and the second cutting edge 1011 is small enough. When the distance between the bottom surface of the tray 101 and the first cutting edge 1021 is small enough, both the first cutting edge 1021 and the second cutting edge 1011 have pierced through the rubbing cloth 20, and the sample of the rubbing cloth 20 is received in the tray.

Figure 6:
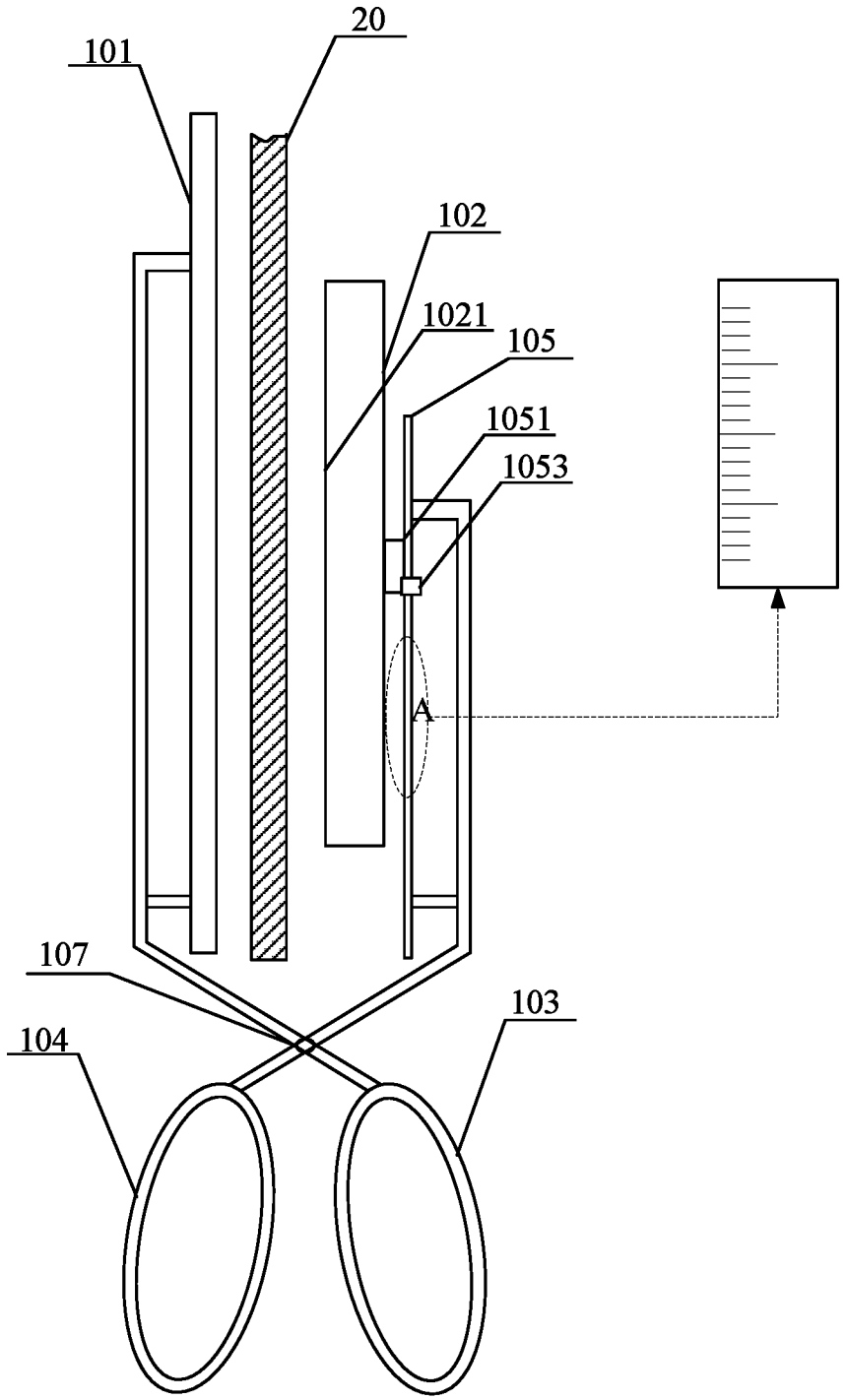
FIG. 6 is a structural schematic view of the pair of sampling scissors according to the another embodiment of the present invention.

Optionally, as shown in FIG. 6, the sampling scissors 10 further comprise a first guide rail 105 which is fixed to the second hand grip 104. A first slider 1051 is disposed on the first guide rail 105 and is fixed to the blade 102. The blade 102 is allowed to slide along the first guide rail 105 by means of the first slider 1051, which includes a first position fixing device 1053, such as a clip, that is movable along the length of the first guide rail 105.

As an example, during shearing the rubbing cloth 20, if the tray 101 covers a large area of the rubbing cloth 20 and a desired sample is located in a position close to the center of the rubbing cloth 20, the blade 102 can be positioned at a desired position for shearing off the sample by sliding the first slider 1051 on the first guide rail 105. Since the tray 101 covers an area that is large enough to cover the desired position, the blade 102 is able to cooperate with the tray 101. Then the desired sample may be sheared off by decreasing the distance between the first hand grip 103 and the second hand grip 104.

In an actual application, scales may also be provided on the first guide rail 105 to facilitate locating a specific position of the blade 102 by an operator, so that the sample sheared off meets a testing standard, as illustrated in the enlarged view of region A in FIG. 6.

Figure 7:
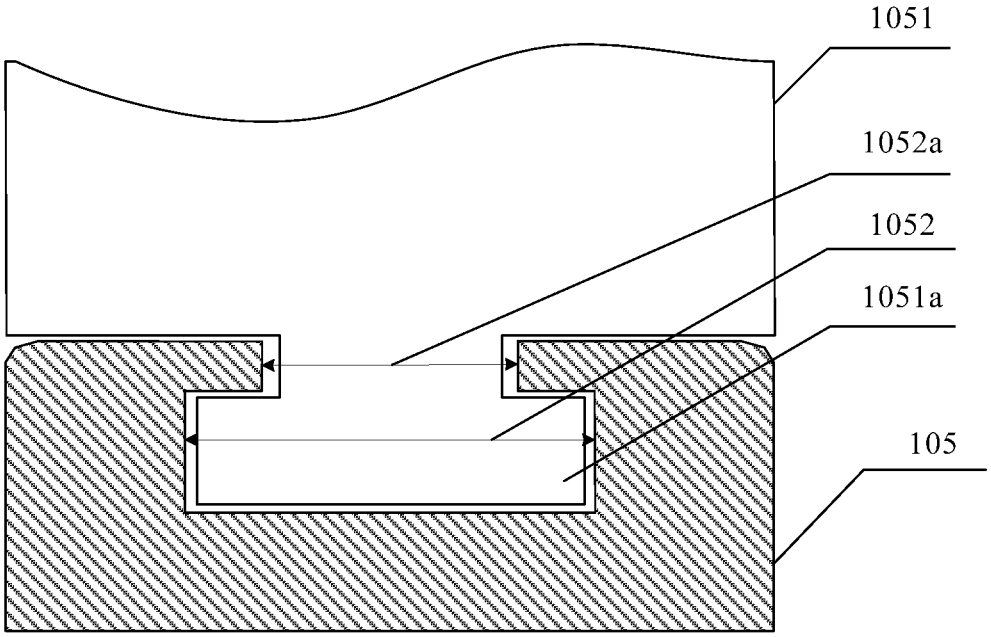
FIG. 7 is a schematic view showing a connection form between a guide rail and a slider according to an embodiment of the present invention.

As an example, as shown in FIG. 7, a first groove 1052 is disposed in the first guide rail 105. The first groove 1052 comprises a first opening 1052*a* close to the first slider 1051, and a width of the first opening 1052 is smaller than a width of the first groove 1052. The first slider 1051 comprises a travelling element 1051*a*, and a width of the travelling element 1051*a* is smaller than or equal to that of the first groove 1052, but larger than that of the first opening 1052*a*. The first slider 1051 may slide into the first groove 1052 from an end of the first guide rail 105 by means of the travelling element 1051*a*; thereafter, the end of the first guide rail 105 is closed such that the first slider 1051 may move on the first guide rail 105. Moreover, with such a clamping structure, the first slider 1051 is not easy to disengage from the first guide rail 105 during its movement.

As an example, the sampling scissors 10 further comprise a first position fixing device for fixing a position of the first slider 1051 on the first guide rail 105. For example, the first position fixing device may be a clip which is movable along the first guide rail 105. The first position fixing device can slide to a position adjacent to the first slider 1051 when the first slider 1051 slides to a preset position along the first guide rail 105, and clip the first slider 1051 and the first guide rail 105 respectively, thereby the first slider 1051 is fixed to the first guide rail 105 temporarily. Thus, a sampling error caused by the sliding movement of the first slider 1051 during sampling the rubbing cloth is avoided, and in turn an accuracy of a testing result is ensured.

Figure 8:
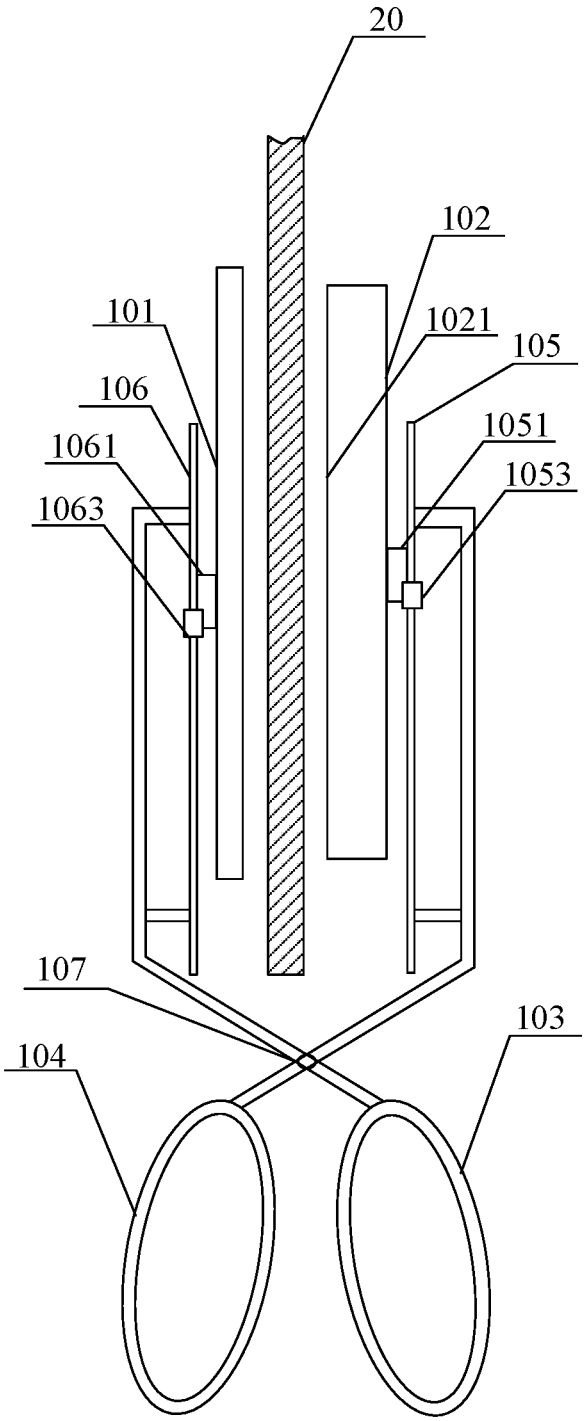
FIG. 8 is a structural schematic view showing a pair of sampling scissors according to a further embodiment of the present invention.

Optionally, as shown in FIG. 8, the sampling scissors 10 further comprise a second guide rail 106 which is fixed to the first hand grip 103. A second slider 1061 is disposed on the second guide rail 106 and is fixed to the tray 101, thereby the tray 101 is allowed to slide along the second guide rail 106 by means of the second slider 1061, which includes a second position fixing device 1063 that is movable along the length of the second guide rail 106.

The tray 101 can be produced large enough in the actual application, but it would increase the difficulty in operation and result in a sampling scissors 10 that is not convenient to be carried. Thus, as an example, the sampling scissors 10 may further comprise the second guide rail 106 and the second slider 1061. During shearing the rubbing cloth 20, if a desired sample is located in a position close to a center of the rubbing cloth 20, both the tray 101 and the blade 102 can be positioned at a desired position for shearing off the sample by sliding the first slider 1051 on the first guide rail 105 and sliding the second slider 1061 on the second guide rail 106 respectively. Then the blade 102 may cooperate with the tray 101 and the desired sample may be sheared off by decreasing the distance between the first hand grip 103 and the second hand grip 104.

In an actual application, scales may be provided on the second guide rail 106 to facilitate positioning a specific position of the tray 101 by an operator, so that the sample sheared off meets the testing standard.

Specifically, the connection between the second guide rail 106 and the second slider 1061 is similar to the connection between the first guide rail 105 and the first slider 1051 as shown in FIG. 7, and a detailed description thereof is omitted herein.

As an example, the sampling scissors 10 further comprise a second position fixing device for fixing a position of the second slider 1061 on the second guide rail 106. In particular, the connections between the second position fixing device and the second guide rail 106 as well as the second slider 1061 are similar to the connections associated with the first position fixing device, and a detailed description thereof is omitted herein.

Optionally, the projection of the first cutting edge 1021 onto the bottom surface of the tray 101 is a hollow quadrilateral. In prior arts, the sheared sample is typically a quadrilateral when testing the resilience of the piles because the quadrilateral sample is easy to be placed in a testing instrument for testing. Thus, the blade 102 may be set into a quadrilateral shape and the first cutting edge 1021 extends along edges of the blade 102, so that the projection of the first cutting edge 1021 onto the bottom surface of the tray 101 is a hollow quadrilateral, and thus the sample sheared off by the above sampling scissors 10 is also a quadrilateral.

Preferably, the shape of the blade 102 may be set into a square having a side length of 7 cm. The first cutting edge 1021 extends along the edges of the blade 102, so that the projection of the first cutting edge 1021 onto the bottom surface of the tray 101 is a hollow square having a side length of 7 cm, and thus a sample sheared off by the above sampling scissors 10 is also a square having a side length of 7 cm, which facilitates placing the sample in the testing instrument for testing.

Optionally, the projection of the first cutting edge 1021 onto the bottom surface of the tray 101 is a hollow circle. In the actual application, the sample sheared off may also be a circle. Thus, the shape of the blade 102 may be set into a circle and the first cutting edge 1021 extends along a peripheral region of the blade 102, so that the projection of the first cutting edge 1021 onto the bottom surface of the tray 101 is a hollow circle, and thus the sample sheared off by the above sampling scissors 10 is also a circle.

Embodiments of the present invention provide a pair of sampling scissors comprising a tray, a blade, a first hand grip and a second hand grip; wherein the tray is connected with the first hand grip and the blade is connected with the second hand grip, and the first hand grip is pivotably connected with the second hand grip through a central shaft. And the blade comprises a first cutting edge disposed at edges of the blade, and a projection of the first cutting edge onto a bottom surface of the tray is a hollow and closed pattern and the first cutting edge is perpendicular to the bottom surface of the tray for shearing off a sample which is to be received in the tray. Compared with the prior art, because the first cutting edge is disposed at edges of the blade and the projection of the first cutting edge onto a bottom surface of the tray is a closed and pattern, when the rubbing cloth is placed between the blade and the tray, the sample of the rubbing cloth may be sheared off by the first cutting edge of the blade by decreasing the distance between the first hand grip and the second hand grip. And the sample has the same shape as the hollow portion of the projection of the first cutting edge, then the sample sheared off is received in the tray. The sample of the rubbing cloth may be obtained through one single shearing operation, damage to the piles of the rubbing cloth around the portion being sheared during the continuous shearing process is thus avoided. And it is not necessary to pull the rubbing cloth during the shearing process, a deformation of the rubbing cloth is thereby avoided, and in turn a change in the positions and sequences of the piles is also avoided, such that the rubbing cloth will meet the requirement of the uniformity of rubbing alignment.

The above are merely the specific implementations of the present invention. However, the scope of the present invention is not limited to this, any change or alternative readily envisaged by those skilled in the art within the scope of the present invention should be also included in the scope of the present invention. Therefore, the scope of the present invention shall be defined in the claims.

What is claimed is:

1. A pair of sampling scissors comprising a tray, a blade, a first hand grip, a second hand grip, a first guide rail, a first slider and a first position fixing device;

wherein the tray is connected with the first hand grip and the blade is connected with the second hand grip, and the first hand grip is pivotably connected with the second hand grip through a central shaft;

wherein the blade comprises a first cutting edge disposed at edges of the blade, a projection of the first cutting edge onto a bottom surface of the tray is a hollow and closed pattern, the first cutting edge is perpendicular to the bottom surface of the tray for shearing off a sample, and the tray is configured to receive the sample;

wherein the first slider is disposed on the first guide rail, which is fixed to the second hand grip, and is fixed to the blade, and the blade is slidable along the length of the first guide rail through the first slider;

wherein the first position fixing device is constructed to fix the first slider to one of a plurality of positions on the first guide rail, and comprises a clip which is movable along the length of the first guide rail; and wherein a first groove, extending along the length of the first guide rail, is disposed in the first guide rail, the first groove comprises a first opening extending along the length of the first guide rail and close to the first slider, a width of the first opening is smaller than a width of the first groove, the first slider has an integral structure that comprises a first slider main body, a travelling element and a first neck portion which is between the first slider main body and the travelling element, and a width of the travelling element is smaller than or equal to that of the first groove but larger than that of the first opening, the travelling element is in the first groove, the first slider main body is out of the first groove and the first neck portion is at the first opening, a width of the first slider main body is larger than that of the first groove, and the blade is fixed on a surface of the first slider main body facing away from the first opening.

2. The pair of sampling scissors of claim 1, wherein, the tray comprises a second cutting edge which is perpendicular to the bottom surface of the tray and is able to cooperate with the first cutting edge to shear off the sample.

3. The pair of sampling scissors of claim 1 further comprising a second guide rail which is fixed to the first hand grip, wherein a second slider is disposed on the second guide rail and is fixed to the tray, thereby the tray is slidable along the second guide rail through the second slider.

4. The pair of sampling scissors of claim 3, wherein a second groove is disposed in the second guide rail, the second groove comprises a second opening close to the second slider, a width of the second opening is smaller than a width of the second groove, and the second slider comprises a travelling element, and a width of the travelling element is smaller than or equal to that of the second groove but larger than that of the second opening.

5. The pair of sampling scissors of claim 3, wherein scales for indicating positions of the blade and/or the tray are disposed on the first guide rail and/or the second guide rail respectively.

6. The pair of sampling scissors of claim 3 further comprising a second position fixing device for fixing a position of the second slider on the second guide rail.

7. The pair of sampling scissors of claim 1, wherein the projection of the first cutting edge onto the bottom surface of the tray is a hollow quadrilateral.

8. The pair of sampling scissors of claim 2, wherein the projection of the first cutting edge onto the bottom surface of the tray is a hollow quadrilateral.

9. The pair of sampling scissors of claim 7, wherein the quadrilateral is a square having a side length of 7 cm.

10. The pair of sampling scissors of claim 1, wherein the projection of the first cutting edge onto the bottom surface of the tray is a hollow circle.

11. The pair of sampling scissors of claim 2, wherein the projection of the first cutting edge onto the bottom surface of the tray is a hollow circle.

12. A method for shearing off a sample using the pair of sampling scissors of claim 1 comprising steps of:

placing an object to be sampled between the tray and the blade;

gripping the first hand grip and the second hand grip to decrease a distance therebetween;

decreasing a distance between the tray and the blade as the distance between the first hand grip and the second hand grip decreases, the blade piercing through the object to be sampled and contacting the tray when a distance between the bottom surface of the tray and the first cutting edge is small enough;

obtaining the sample through a single shearing by the sampling scissors and receiving it in the tray.

13. The method of claim 12, wherein the object to be sampled is a rubbing cloth for a rubbing process, a fabric, a plastic plate, a rubber or metal plate.

14. A method for shearing off a sample using the pair of sampling scissors of claim 1 comprising steps of:

placing an object to be sampled between the tray and the blade;

sliding the first slider on the first guide rail to position the blade in a position for shearing off the sample;

gripping the first hand grip and the second hand grip to decrease a distance therebetween;

decreasing a distance between the tray and the blade as the distance between the first hand grip and the second hand grip decreases, the blade piercing through the object to be sampled and contacting the tray when a distance between the bottom surface of the tray and the first cutting edge is small enough;

obtaining the sample through a single shearing by the sampling scissors and receiving it in the tray.

15. The method of claim 14, wherein the object to be sampled is a rubbing cloth for a rubbing process, a fabric, a plastic plate, a rubber or metal plate.

* * * * *